US009904224B2

(12) United States Patent
Suzuki et al.

(10) Patent No.: US 9,904,224 B2
(45) Date of Patent: Feb. 27, 2018

(54) IMAGE FORMING APPARATUS, AND METHOD AND COMPUTER-READABLE MEDIUM FOR THE SAME

(71) Applicant: BROTHER KOGYO KABUSHIKI KAISHA, Nagoya, Aichi (JP)

(72) Inventors: Takashi Suzuki, Aichi (JP); Tomohiro Kondo, Aichi (JP); Yoshihiro Oyama, Tokai (JP); Tatsuaki Mori, Kuwana (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/252,890

(22) Filed: Aug. 31, 2016

(65) Prior Publication Data

US 2017/0060060 A1 Mar. 2, 2017

(30) Foreign Application Priority Data

Aug. 31, 2015 (JP) ..... 2015-170106

(51) Int. Cl.
*G03G 15/23* (2006.01)
*G03G 15/20* (2006.01)
*G03G 15/00* (2006.01)

(52) U.S. Cl.
CPC ..... *G03G 15/235* (2013.01); *G03G 15/205* (2013.01); *G03G 15/5029* (2013.01); *G03G 15/6579* (2013.01); *G03G 2215/0043* (2013.01); *G03G 2215/2045* (2013.01)

(58) Field of Classification Search
CPC combination set(s) only.
See application file for complete search history.

(56) References Cited

U.S. PATENT DOCUMENTS

2003/0230561 A1* 12/2003 Kagawa ..... H05B 1/0241 219/216
2004/0042825 A1* 3/2004 Yasui ..... G03G 15/2039 399/320

(Continued)

FOREIGN PATENT DOCUMENTS

JP 2006267343 A 10/2006
JP 2007155855 A 6/2007

(Continued)

*Primary Examiner* — Clayton E Laballe
*Assistant Examiner* — Jas Sanghera
(74) *Attorney, Agent, or Firm* — Scully, Scott, Murphy & Presser, P.C.

(57) ABSTRACT

An image forming apparatus includes a process unit configured to form a toner image on a sheet, a fuser configured to heat the sheet passed through the process unit thereby fixing the toner image onto the sheet, a re-conveyor configured to convey the sheet passed through the fuser to the process unit, and a controller configured to perform particular duplex printing including controlling, when a temperature of the fuser is a first temperature, the re-conveyor to convey the sheet passed through the fuser to the process unit in a first period of time, and controlling, when the temperature of the fuser is a second temperature higher than the first temperature, the re-conveyor to convey the sheet passed through the fuser to the process unit in a second period of time longer than the first period of time.

19 Claims, 7 Drawing Sheets

(56) References Cited

U.S. PATENT DOCUMENTS

| | | | | |
|---|---|---|---|---|
| 2004/0213610 | A1* | 10/2004 | Yuasa | B41J 3/60 399/401 |
| 2006/0214974 | A1 | 9/2006 | Isobe et al. | |
| 2011/0103808 | A1* | 5/2011 | Abe | G03G 15/234 399/16 |
| 2011/0236101 | A1* | 9/2011 | Uehara | G03G 15/235 399/400 |
| 2011/0318078 | A1 | 12/2011 | Aoi | |

FOREIGN PATENT DOCUMENTS

| | | | |
|---|---|---|---|
| JP | 2008111888 | A | 5/2008 |
| JP | 2010002439 | A | 1/2010 |
| JP | 2012008346 | A | 1/2012 |

* cited by examiner

IMAGE FORMING APPARATUS, AND METHOD AND COMPUTER-READABLE MEDIUM FOR THE SAME

CROSS-REFERENCE TO RELATED APPLICATION

This application claims priority under 35 U.S.C. §119 from Japanese Patent Application No. 2015-170106 filed on Aug. 31, 2015. The entire subject matter of the application is incorporated herein by reference.

BACKGROUND

Technical Field

The following description relates to aspects of an image forming apparatus, and a method and a computer-readable medium for controlling the image forming apparatus.

Related Art

An image forming apparatus has been known that includes a process unit, a fuser, and a re-conveyor and is configured to perform duplex printing. In the image forming apparatus, the process unit forms a toner image on a first side of a sheet being conveyed, and the fuser thermally fixes the toner image onto the first side of the sheet. The re-conveyor again conveys the sheet passed through the fuser to the process unit, with the sheet being turned upside down. The process unit forms a toner image on a second side of the sheet re-conveyed, and the fuser thermally fixes the toner image onto the second side of the sheet. Thus, an image is formed on each side of the sheet.

In the known image forming apparatus, the sheet heated by the fuser is re-conveyed to the process unit by the re-conveyor. Therefore, for instance, when an ambient temperature of the process unit rises, it might result in a lower quality of image. In order to solve the problem, an image forming apparatus has been proposed that is configured to cool a sheet being re-conveyed by a re-conveyor with an air current flowing through an air guide formed at the re-conveyor.

SUMMARY

A temperature of the re-conveyed sheet varies depending on a temperature of the fuser. Hence, when the temperature of the fuser is relatively high, there is a risk that the re-conveyed sheet might not be adequately cooled.

Aspects of the present disclosure are advantageous to provide one or more improved techniques, for an image forming apparatus, which make it possible to adequately cool a re-conveyed sheet.

According to aspects of the present disclosure, an image forming apparatus is provided, which includes a process unit configured to form a toner image on a sheet, a fuser configured to heat the sheet passed through the process unit thereby thermally fixing the toner image onto the sheet, a re-conveyor configured to convey the sheet passed through the fuser to the process unit, and a controller configured to perform particular duplex printing including controlling, when a temperature of the fuser is a first temperature, the re-conveyor to convey the sheet passed through the fuser to the process unit in a first period of time, and controlling, when the temperature of the fuser is a second temperature higher than the first temperature, the re-conveyor to convey the sheet passed through the fuser to the process unit in a second period of time, which is longer than the first period of time.

According to aspects of the present disclosure, further provided is a method adapted to be implemented on a processor coupled with an image forming apparatus including a process unit, a fuser, and a re-conveyor, the method including controlling, when a temperature of the fuser is a first temperature, the re-conveyor to convey the sheet passed through the fuser to the process unit in a first period of time, and controlling, when the temperature of the fuser is a second temperature higher than the first temperature, the re-conveyor to convey the sheet passed through the fuser to the process unit in a second period of time, which is longer than the first period of time.

According to aspects of the present disclosure, further provided is a non-transitory computer-readable medium storing computer-readable instructions that are executable by a processor coupled with an image forming apparatus, which includes a process unit, a fuser, and a re-conveyor. The instructions are configured to, when executed by the processor, cause the processor to perform particular duplex printing including controlling, when a temperature of the fuser is a first temperature, the re-conveyor to convey the sheet passed through the fuser to the process unit in a first period of time, and controlling, when the temperature of the fuser is a second temperature higher than the first temperature, the re-conveyor to convey the sheet passed through the fuser to the process unit in a second period of time, which is longer than the first period of time.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Figure 1:
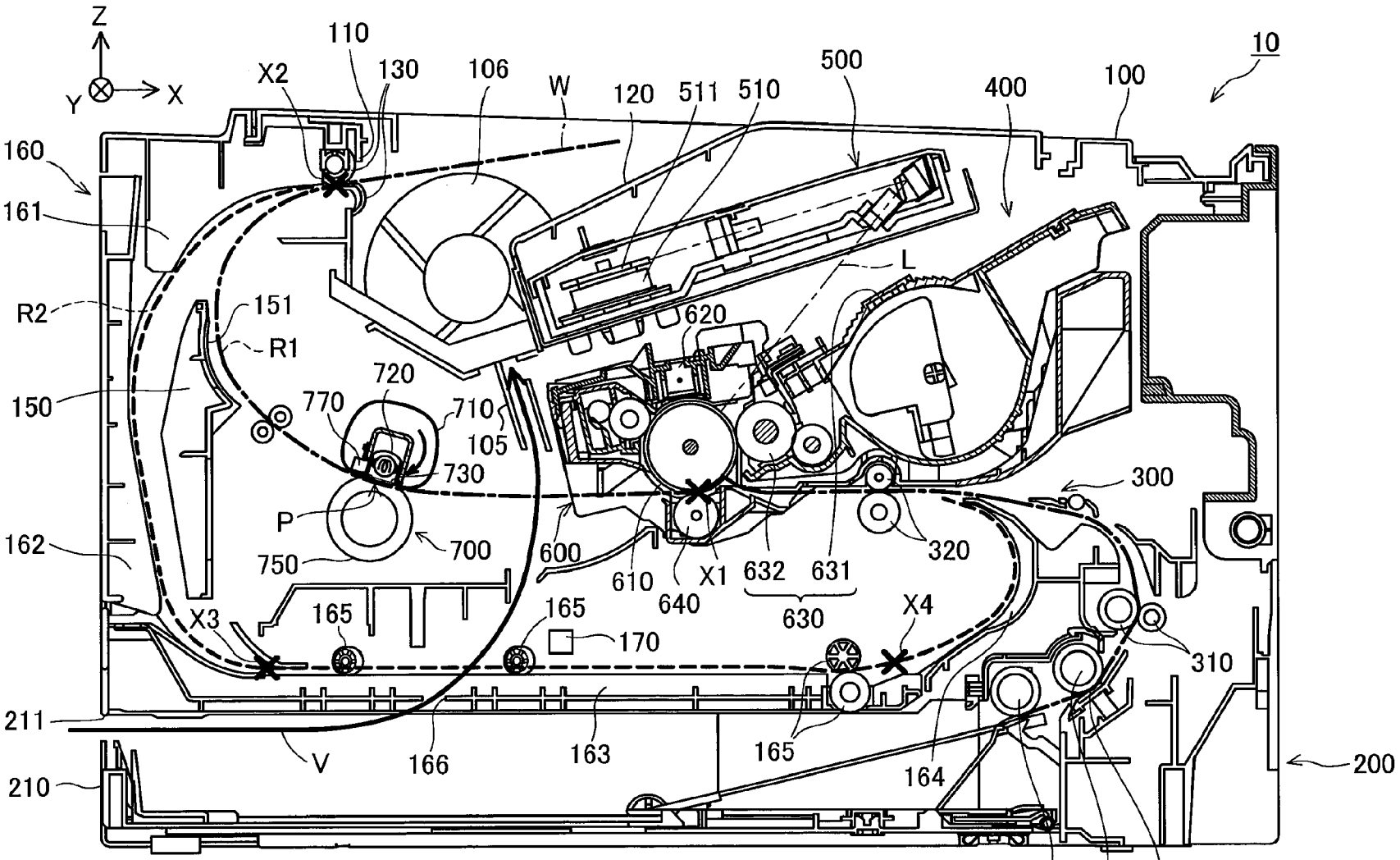
FIG. 1 is a cross-sectional side view schematically showing an overall configuration of a printer in an illustrative embodiment according to one or more aspects of the present disclosure.

Hereinafter, a printer 10 of an illustrative embodiment according to aspects of the present disclosure will be described with reference to the accompanying drawings. FIG. 1 is a cross-sectional view schematically showing an overall configuration of the printer 10. FIG. 1 shows an X-axis, a Y-axis, and a Z-axis that are orthogonal to each other. In the following description, for the sake of explanatory convenience, a positive direction along the Z-axis will be referred to as an upward direction. A negative direction along the Z-axis will be referred to as a downward direction. A positive direction along the X-axis will be referred to as a frontward direction. A negative direction along the X-axis will be referred to as a rearward direction. A positive direction along the Y-axis will be referred to as a rightward direction. A negative direction along the Y-axis will be referred to as a leftward direction. The same will apply to FIG. 2 and the following drawings.

The printer 10 is an electrophotographic printer configured to form an image on a sheet W such as a recording paper and a transparency with toner (developer) of a single color (e.g., black).

As shown in FIG. 1, the printer 10 includes a casing 100, a sheet feeder 200, a sheet conveyor 300, and an image forming device 400. The casing 100 accommodates the sheet feeder 200, the sheet conveyor 300, and the image forming device 400. Further, at an upper surface of the casing 100, a discharge port 110 and a discharge tray 120 are formed. Discharge rollers 130 are disposed in a position close to the discharge port 110 of the casing 100.

The sheet feeder 200 includes a tray 210, a pickup roller 220, a separation roller 221, and a separation pad 222. The tray 210 accommodates one or more sheets W. The pickup roller 220 is configured to pick up and feed one or more sheets W placed on the tray 210. The separation roller 221 and the separation pad 222 are configured to pinch therebetween the sheets W fed by the pickup roller 220, and feed the sheets W toward the sheet conveyor 300 on a sheet-by-sheet basis.

The sheet conveyor 300 includes conveyance rollers 310 and registration rollers 320. The conveyance rollers 310 are configured to convey the sheets W fed by the sheet feeder 200, toward the registration rollers 320. The registration rollers 320 are configured to perform skew correction for the sheets W conveyed by the conveyance rollers 310, and convey the sheets W toward the image forming device 400.

The image forming device 400 includes an exposure device 500, a process unit 600, and a fuser 700. The exposure device 500 is configured to emit a laser beam L onto a photoconductive body 610 of the process unit 600. Specifically, the exposure device 500 includes a light source (not shown), a polygon mirror 511, and a scanner motor 510. The light source is configured to emit a laser beam L. The polygon mirror 511 is driven to rotate by the scanner motor 510, and configured to deflect the laser beam L emitted by the light source, to be incident onto the photoconductive body 610.

The process unit 600 includes the photoconductive body 610, a charger 620, a developer 630, and a transfer roller 640. The photoconductive body 610 is a drum-shaped member configured to rotate around an axis. The charger 620 is disposed to face a surface of the photoconductive body 610. The charger 620 is configured to evenly charge the surface of the photoconductive body 610. The developer 630 includes a toner box 631 and a development roller 632. The toner box 631 accommodates toner. The development roller 632 is configured to supply toner stored in the toner box 631 to the surface of the photoconductive body 610. The transfer roller 640 is disposed to face the photoconductive body 610. The transfer roller 640 is configured to, when supplied with a voltage, transfer a toner image formed on the surface of the photoconductive body 610 onto a sheet W.

When the laser beam L from the exposure device 500 is emitted onto the surface of the photoconductive body 610 charged by the charger 620, an electrostatic latent image is formed on the surface of the photoconductive body 610. When toner is supplied to the surface of the photoconductive body 610 by the developer 630, the electrostatic latent image formed on the surface of the photoconductive body 610 is developed. Thereby, a toner image is formed on the surface of the photoconductive body 610. The toner image formed on the surface of the photoconductive body 610 is transferred by the transfer roller 640 onto a sheet W passing through a position where the photoconductive body 610 and the transfer roller 640 face each other. Hereinafter, the position where the photoconductive body 610 and the transfer roller 640 face each other may be referred to as a "transfer position X1."

The fuser 700 is configured to heat the sheet W passed through the process unit 600, and fix onto the sheet W the toner image transferred onto the sheet W. Thereby, an image is formed on the sheet W. Specifically, the fuser 700 includes a fixing belt 710, a halogen heater 720, a nip member 730, a pressing roller 750, and a thermistor 770. The fixing belt 710 is a tube-shaped band configured to rotate. The halogen heater 720 is a heat generating body configured to, when supplied with electricity from an alternate-current power supply (not shown), generate heat. The halogen heater 720 is disposed in a region surrounded by the fixing belt 710. The pressing roller 750 is disposed to contact the fixing belt 710. The pressing roller 750 is pressed against the fixing belt 710. The nip member 730 includes a metal plate. The nip member 730 is configured to pinch the fixing belt 730 with the pressing roller 750. A nip P is defined as a portion between the fixing belt 710 and the pressing roller 750. The thermistor 770 is disposed in such a position as to contact the nip member 730. The thermistor 770 is a temperature sensor configured to output a temperature signal depending on a temperature of the nip member 730 to a controller 800.

When the halogen heater 720 generates heat, the fixing belt 710 is heated by the halogen heater 720 through the nip member 730. Thus, the temperature of the fixing belt 710 increases. Further, when the pressing roller 750 is driven to rotate by a driving force from the process motor 811, the fixing belt 710 moves in accordance with the rotation of the pressing roller 750. When the sheet W passed through the process unit 600 reaches the nip P between the fixing belt 710 and the pressing roller 750, the sheet W is heated by the fixing belt 710 while being conveyed by the fixing belt 710 and the pressing roller 750. Thereby, the toner image formed on the surface of the sheet W is thermally fixed. The discharge rollers 130 discharge the sheet W passed through the fuser 700 onto the discharge tray 120 via the discharge port 110. Hereinafter, a conveyance path of the sheet W, which extends from the sheet feeder 200 to the discharge rollers 130 via the sheet conveyor 300, the transfer position X1, and the nip P of the fuser 700, will be referred to as a "conveyance path R1." A direction in which the sheet W is conveyed along the conveyance path R1 will be referred to as a "conveyance direction."

The casing 100 further includes a conveyance guide 150. The conveyance guide 150 is disposed downstream of the fuser 700 in the conveyance direction. As shown in FIG. 1, the conveyance guide 150 includes a curved portion 151 positioned behind (i.e., on a rear side of) the conveyance path R1. The curved portion 151 is concave substantially in a rearward direction. In other words, the curved portion 151 is concave substantially in a direction of a specific surface of the sheet W being guided by the conveyance guide 150 in contact between the curved portion 151 and the specific surface. Thus, the conveyance guide 150 (more specifically, the curved portion 151) is configured to guide the sheet W to the discharge rollers 130 in contact with the specific surface of the sheet W passed through the fuser 700. The specific surface of the sheet W is a surface that faces the pressing roller 750 when the sheet W passes through the fuser 700.

The casing 100 further includes a re-conveyor 160. The re-conveyor 160 is configured to re-convey the sheet W passed through the fuser 700 to the process unit 600, with the sheet being turned upside down. Specifically, the re-conveyor 160 includes the aforementioned discharge rollers 130, a first re-conveyance guide 161, a second re-conveyance guide 162, a third re-conveyance guide 163, a fourth re-conveyance guide 164, and a plurality of rollers 165. The first to fourth re-conveyance guides 161 to 164 are configured to define a re-conveyance path R2. The re-conveyance path R2 extends from the discharge rollers 130, and passes by a position behind the conveyance guide 150, a position below the image forming device 400, and a position behind the sheet conveyor 300. Hereinafter, a direction in which the sheet W is re-conveyed along the re-conveyance path R2 will be referred to as a "re-conveyance direction."

The first re-conveyance guide 161 is disposed in a position opposite to the fuser 700 with respect to the conveyance guide 150. The first re-conveyance guide 161 includes a section extending from a position closer to the discharge rollers 130 than the conveyance guide 150 to a position behind the conveyance guide 150. The second re-conveyance guide 162 is disposed behind (i.e., on a rear side of) the conveyance guide 150. The second re-conveyance guide 162 includes a section extending substantially in the vertical direction. The third re-conveyance guide 163 is disposed between the process unit 600 or the fuser 700, and the sheet feeder 200 in the vertical direction. The third re-conveyance guide 163 includes a section extending substantially in the front-to-rear direction. The fourth re-conveyance guide 164 is disposed between the third re-conveyance guide 163 and the registration rollers 320 in the vertical direction. The fourth re-conveyance guide 164 includes a U-shaped section extending from a position close to the third re-conveyance guide 163 toward the registration rollers 320. The rollers 165 are disposed along the third re-conveyance guide 163. The rollers 165 are driven to rotate by the driving force from the process motor 811. Further, the aforementioned discharge rollers 130 are configured to be driven to rotate in both of a forward direction and a backward direction by the driving force from a discharge motor 812. Hereinafter, a position where the discharge rollers 130 are opposed to each other will be referred to as a "discharge position X2." A position between the discharge position X2 and the rollers 165 on the re-conveyance path R2 will be referred to as a "before-roller position X3." A position between the rollers 165 and the registration rollers 320 on the re-conveyance path R2 will be referred to as an "after-roller position X4."

Further, the casing 100 includes a duct 105 formed therein. An end of the duct 105 communicates with a fan 106 for exhaust. The other end of the duct 105 communicates with the outside of the casing 100 via a ventilation hole 166 formed at the third re-conveyance guide 163 and a gap 211 between the casing 100 and the tray 210. When the fan 106 rotates, the outside air is introduced into the duct 105 via the gap 211 and the ventilation hole 166. Thereby, an air current V crossing the conveyance path R1 and the re-conveyance path R2 is generated inside the casing 100.

The printer 10 further includes a temperature sensor 170. The temperature sensor 170 is disposed close to the ventilation hole 166. The temperature sensor 170 is configured to output a signal depending on an outside air temperature.

Figure 2:
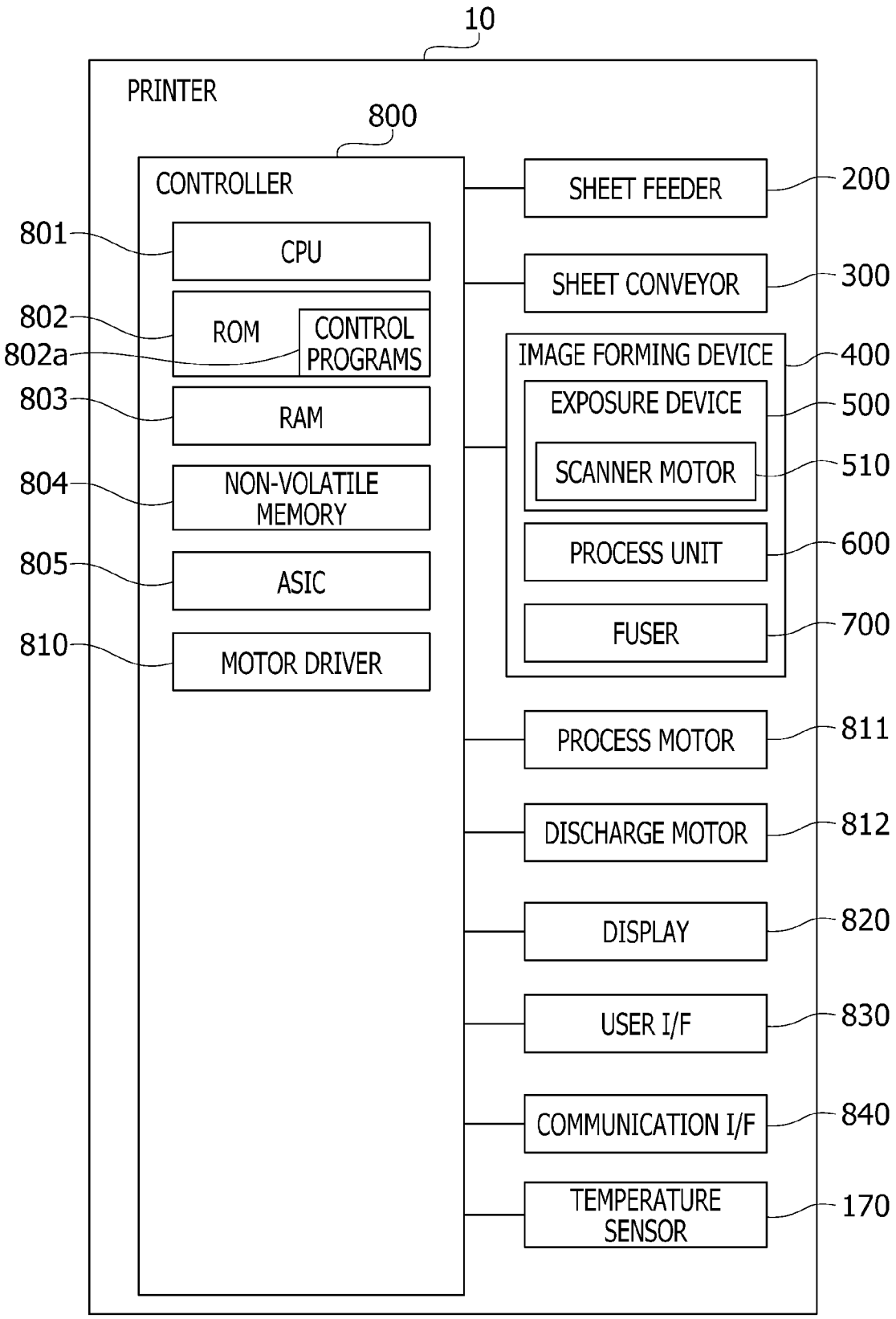
FIG. 2 is a block diagram schematically showing an electrical configuration of the printer in the illustrative embodiment according to one or more aspects of the present disclosure.

FIG. 2 is a block diagram showing an electrical configuration of the printer 10. The printer 10 further includes the controller 800, a display 820, a user interface 830, and a communication interface 840, as well as the sheet feeder 200, the sheet conveyor 300, and the image forming device 400.

The controller 800 includes a CPU 801, a ROM 802, a RAM 803, a nonvolatile memory 804, an ASIC (which is an abbreviated form of Application Specific Integrated Circuit) 805, and a motor driver 810. The ROM 802 stores therein control programs 802*a* and various setting information for controlling the printer 10. The RAM 803 is used as a work area and/or a temporary data storage area when the CPU 801 executes programs. The nonvolatile memory 804 includes a rewritable memory such as an NVRAM, a flash memory, an HDD, and an EEPROM. The ASIC 805 includes a hardware circuit for image processing. The CPU 801 is configured to control each of elements included in the printer 10 in accordance with one or more control programs 802*a* read out from the ROM 802 and signals from various sensors. The motor driver 810 is configured to drive the scanner motor 510, the process motor 811, and a discharge motor 812. The controller 80 is further configured to acquire an outside air temperature based on a signal output from the temperature sensor 170.

The process motor 811 is configured to drive the pickup roller 220, the registration rollers 320, the photoconductive body 610, the development roller 632, the pressing roller 750 of the fuser 700, and the rollers 165 of the re-conveyor 160. The process motor 811 is rotatable in a forward direction and a backward direction. The process motor 811 is configured to rotate the discharge rollers 130 in both of the forward direction and the backward direction. When the process motor 811 rotates in the forward direction, the discharge rollers 130 are driven to rotate in the forward direction such that a sheet W is discharged out of the casing 100. Meanwhile, when the process motor 811 rotates in the backward direction, the discharge rollers 130 are driven to rotate in the backward direction such that the sheet W is pulled into the casing 100.

The display 820 may be a liquid crystal display. The display 820 is configured to display various kinds of information in accordance with instructions from the controller 800. The user interface 830 includes various buttons configured to accept user operations. The communication interface 840 is hardware that enables communication with external devices. The communication interface 840 may include at least one of a network interface, a serial communication interface, and a parallel communication interface.

Subsequently, a print control process by the controller 800 will be described. In response to accepting a print instruction to form images on sheets W, e.g., via the user interface 830 or the communication interface 840, the controller 800 launches a print control process. More specifically, the print control process may be performed by the CPU 801 (see FIG. 2) executing one or more control programs 802*a* stored in the RAM 802.

Figure 3:
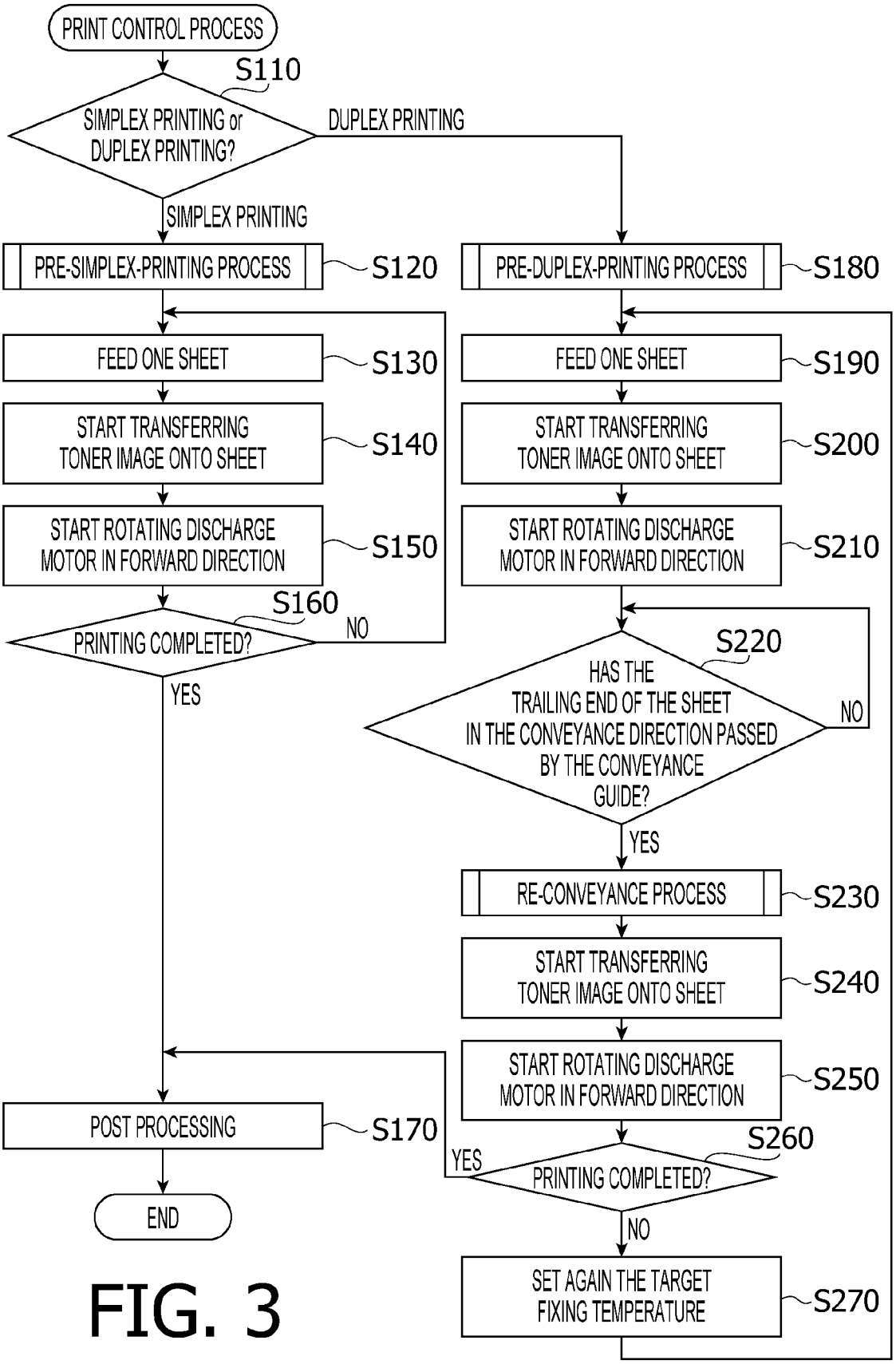
FIG. 3 is a flowchart showing a procedure of a print control process in the illustrative embodiment according to one or more aspects of the present disclosure.
Figure 4:
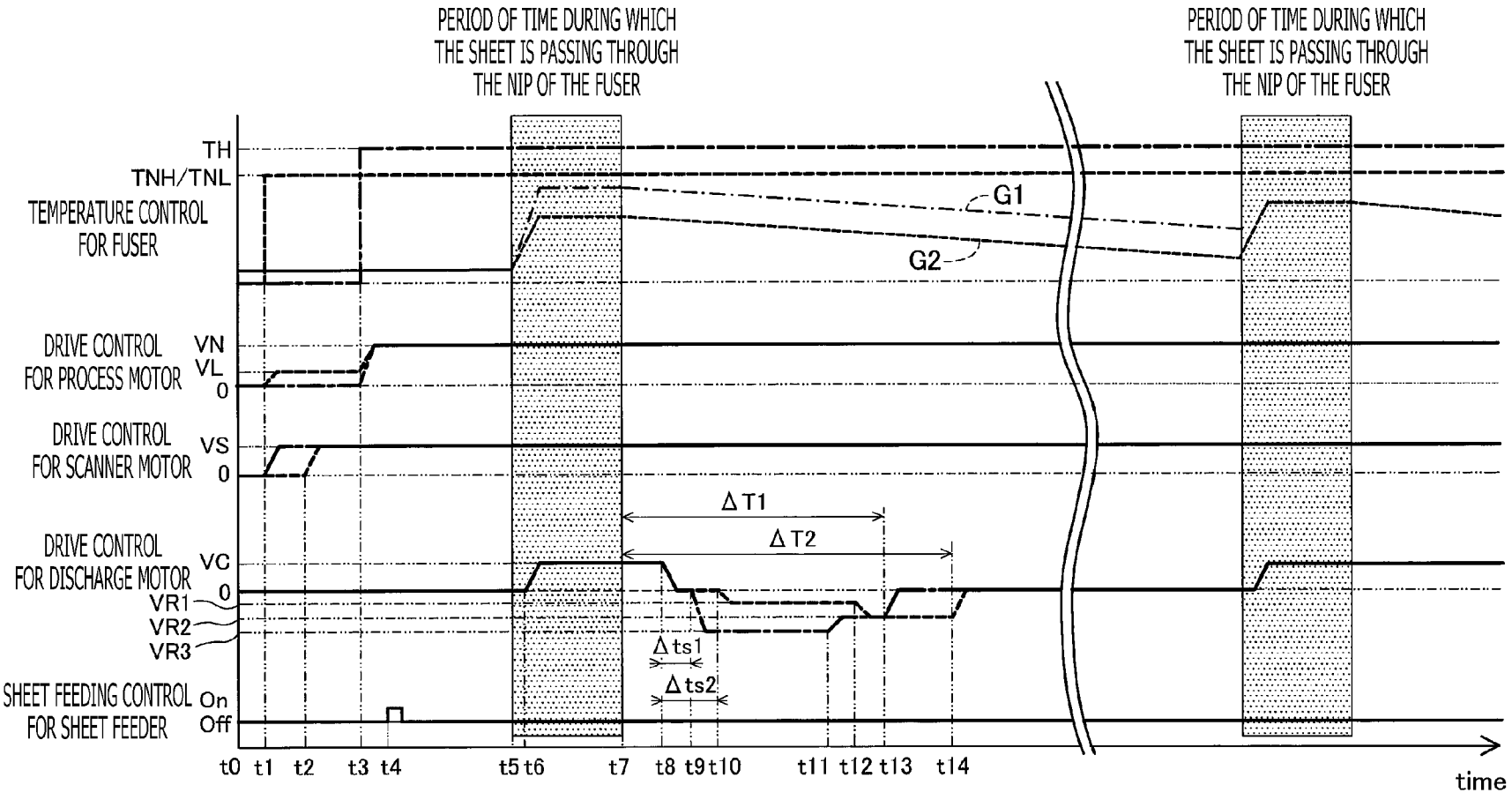
FIG. 4 is a timing chart showing a timing relationship among temperature control for a fuser, drive control for each of a process motor, a scanner motor, and a discharge motor, and sheet feeding control for a sheet feeder, in the illustrative embodiment according to one or more aspects of the present disclosure.

FIG. 3 is a flowchart showing a procedure of the print control process. FIG. 4 is a timing chart showing a timing relationship among temperature control for the fuser 700, drive control for each of the motors 510, 811, and 812, and sheet feeding control for the sheet feeder 200. Regarding the aforementioned controls except for the drive control of the discharge motor 812, each dashed line indicates a change in time of a control parameter for the corresponding control in duplex printing. Additionally, each alternate long and short dash line indicates a change in time of the control parameter for the corresponding control in simplex printing. Further, each solid line indicates a change in time of the control parameter for the corresponding control in common with the duplex printing and the simplex printing. Regarding the drive control for the discharge motor 812, a dashed line indicates a change in time of a control parameter (i.e., a control voltage) for second re-conveyance control in the duplex printing. Additionally, an alternate long and short dash line indicates a change in time of the control voltage for first re-conveyance control in the duplex printing. Further, a solid line indicates a change in time of the control voltage in common with the first re-conveyance control and the second re-conveyance control. Further, FIG. 4 shows a graph line G2 representing a change in time of the temperature of the sheet W in the duplex printing and a graph line G1 representing a change in time of the temperature of the sheet W in the simplex printing. The following description will be provided under assumptions that, before a print instruction is accepted, driving the motors 510, 811, and 812 and supplying sheets W from the sheet feeder 200 are stopped. Further, it is assumed that, before a print instruction is accepted, the temperature control for the fuser 700 is stopped, or the fuser 700 is maintained at a particular temperature (e.g., a temperature in a sleep mode or a standby mode) lower than a target fixing temperature (see timing t0 in FIG. 4).

Firstly, in response to accepting a print instruction, the controller 800 determines whether the accepted print instruction is directed to the simplex printing or the duplex printing (S110). When determining that the accepted print instruction is directed to the simplex printing (S110: simplex printing), the controller 800 goes to S120. In S120, the controller 800 performs a pre-simplex-printing process.

Figure 5:
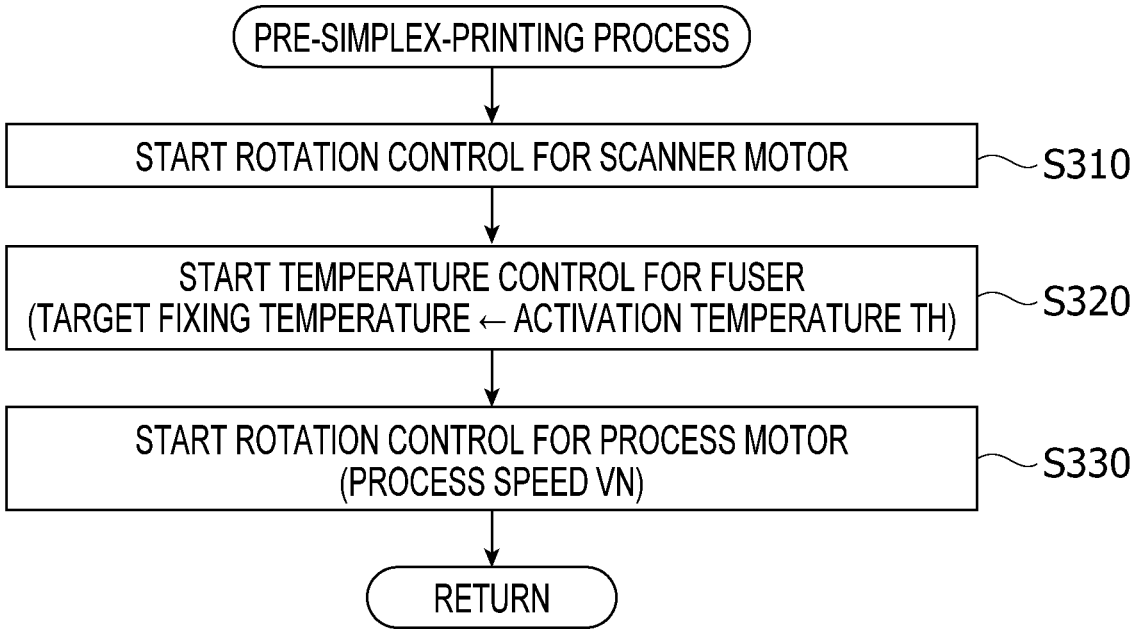
FIG. 5 is a flowchart showing a procedure of a pre-simplex-printing process in the illustrative embodiment according to one or more aspects of the present disclosure.

FIG. 5 is a flowchart showing a procedure of the pre-simplex-printing process. The controller 800 starts rotation control for controlling the scanner motor 510 to rotate at a scanner speed VS by the motor driver 810 (S310, see timing t1 in FIG. 4). Subsequently, the controller 800 sets the target fixing temperature to an activation temperature TH, and starts temperature control for bringing a temperature of the fixing belt 710 closer to the activation temperature TH based on a temperature signal from the thermistor 770 (S320, see timing t3 in FIG. 4). The activation temperature TH is higher than a temperature suitable for fixing. Further, the controller 800 starts rotation control for controlling the process motor 811 to rotate at a process speed VN by the motor driver 810 (S300, see timing t3 in FIG. 4). The process speed VN is a rotational speed of the process motor 811 when the process unit 600 forms an image on a sheet W. Thereby, the pickup roller 220, the registration rollers 320, the photoconductive body 610, the development roller 632, and the pressing roller 750 of the fuser 700 are driven to rotate at respective speeds corresponding to the process speed VN in respective rotational directions such as to convey the sheet W along the conveyance path R1. The controller 800 may execute S320 and S330 at the same timing or mutually-different timings.

A reason why the target fixing temperature is set to the activation temperature TH in the pre-simplex-printing process will be described below. In the pre-simplex-printing process, by making the timing to start the rotation control for the process motor 811 as late as possible, it is possible to prevent deterioration of the toner stored in the toner box 631 and/or the development roller 632 due to rotation of the development roller 632. Nonetheless, the fuser 700 needs to be driven in a state where a lubricant between the fixing belt 710 and the nip member 730 is thermally melted. Therefore, the fixing belt 710 begins to be rotated provided that the temperature control for the fuser 700 has been started. Further, the fixing belt 710 and the development roller 632 are driven to rotate by the same process motor 811. Accordingly, when the timing to start the rotation control for the process motor 811 (e.g., the development roller 632) is delayed, the timing to start the temperature control for the fuser 700 is delayed as well accordingly. As the temperature control for the fuser 700 is delayed, there is a risk that a period of time required for completing a printing operation after acceptance of a print instruction might be longer. Thus, in order to prevent the required period of time from being longer, the target fixing temperature is set to the activation temperature TH higher than the temperature suitable for fixing.

After completing the pre-simplex-printing process, the controller 800 goes to S130 in FIG. 3. In S130, the controller 800 controls the sheet feeder 200 to feed one sheet W (see timing t4 in FIG. 4). Then, the controller 800 controls the process unit 600 to start transferring a toner image onto a single side of the sheet W passing through the transfer position X1 (S140). Afterward, the sheet W with the toner image transferred thereon is heated for a period of time during which the sheet W is passing through the nip P of the fuser 700 (see timings t5 to t7 in FIG. 4). During this period of time, since the target fixing temperature is set to the activation temperature TH, the temperature of the sheet W is higher than when the duplex printing is performed, as indicated by the graph line G1 in FIG. 4.

Subsequently, when determining that a particular timing (see timing t6 in FIG. 4) at which a leading end of the sheet W in the conveyance direction is between the fuser 700 and the discharge rollers 130 has come, the controller 800 starts rotating the discharge motor 812 in the forward direction (S150). Further, when determining that a particular timing (see timing t8 in FIG. 4) at which a trailing end of the sheet W in the conveyance direction passes through the discharge position X2 has come, the controller 800 stops the discharge motor 812. Thereby, the simplex-printed sheet W is discharged onto the discharge tray 120. The controller 800 may determine whether each of the timings t6 and t8 has come, e.g., based on a signal from a sheet sensor (not shown) or a period of time elapsed since the registration rollers 320 fed the sheet W.

Subsequently, the controller 800 determines whether all of the pages specified by the print instruction have been completely printed (S160). When determining that all of the pages specified by the print instruction have not been completely printed (S160: No), the controller 800 goes back to S130. In S130, simplex printing is performed on a next sheet W. Meanwhile, when determining that all of the pages specified by the print instruction have been completely printed (S160: Yes), the controller 800 performs post processing (S170). For instance, the post processing includes stopping the temperature control for the fuser 700 and stopping the motors 510, 811, and 812. Thereafter, the controller 800 terminates the print control process.

Figure 6:
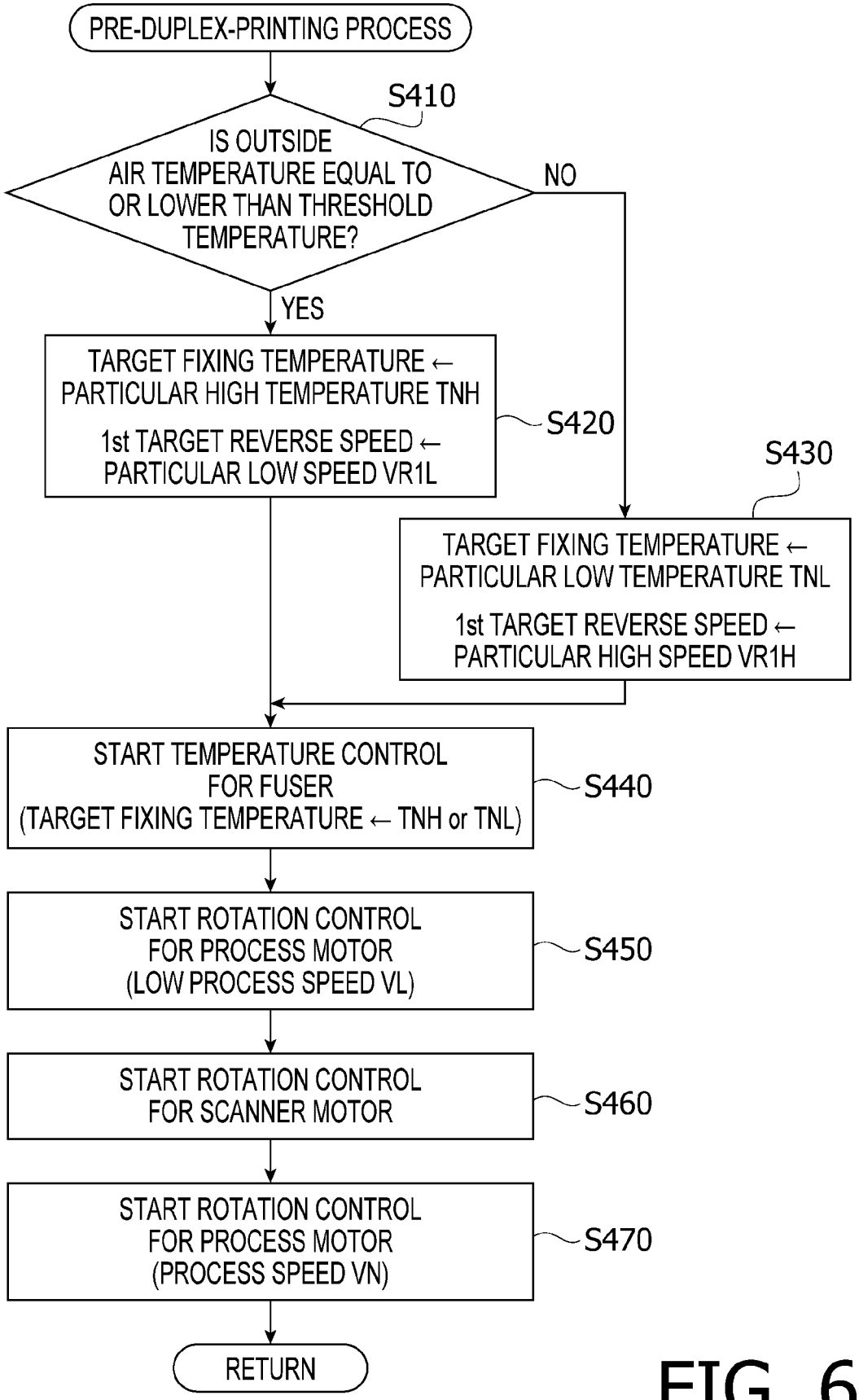
FIG. 6 is a flowchart showing a procedure of a pre-duplex-printing process in the illustrative embodiment according to one or more aspects of the present disclosure.

In S110, when determining that the accepted print instruction is directed to the duplex printing (S110: duplex printing), the controller 800 goes to S180. In S180, the controller 800 performs a pre-duplex-printing process. FIG. 6 is a flowchart showing a procedure of the pre-duplex-printing process. The controller 800 determines whether an outside air temperature is equal to or lower than a threshold temperature (e.g., 15° C.), based on a temperature signal from the temperature sensor 170 (S410). When determining that the outside air temperature is equal to or lower than the threshold temperature (S410: Yes), the controller 800 sets the target fixing temperature to a particular high temperature TNH, and sets a first target reverse speed VR1 to a particular low speed VR1L (S420). The particular high temperature TNH is equal to or higher than the temperature suitable for fixing, and is lower than the activation temperature TH. The target reverse speed is a rotational speed of the discharge motor 812 rotating in the backward direction. Meanwhile, when determining that the outside air temperature is higher than the threshold temperature (S410: No), the controller 800 sets the target fixing temperature to a particular low temperature TNL, and sets the first target reverse speed VR1 to a particular high speed VR1H (S430). The particular low temperature TNL is equal to or higher than the temperature suitable for fixing and lower than the particular high temperature TNH. Namely, the lower the outside air temperature is, the higher the target fixing temperature is set to be, and the lower the first target reverse speed VR1 is set to be accordingly.

After execution of S420 or S430, the controller 800 starts temperature control for bringing the temperature of the fixing belt 710 close to the particular high temperature TNH or the particular low temperature TNL on the basis of the temperature signal from the thermistor 770 (S440, see timing t1 in FIG. 1). In FIG. 4, the particular high temperature TNH and the particular low temperature TNL are indicated by the same dashed line. Further, the controller 800 starts rotation control for controlling the process motor 811 to rotate at a low process speed VL by the motor driver 810 (S450, see timing t1 in FIG. 4). The low process speed VL is lower than the aforementioned process speed VN. Thereby, the pickup roller 220, the registration rollers 320, the photoconductive body 610, the development roller 632, and the pressing roller 750 of the fuser 700 are driven to rotate at respective speeds corresponding to the low process speed VL in respective rotational directions such as to convey the sheet W along the conveyance path R1. Further, the plurality of rollers 165 of the re-conveyor 160 are driven to rotate at respective speeds corresponding to the low process speed VL in respective rotational directions such as to convey the sheet W along the re-conveyance path R2. Subsequently, the controller 800 starts rotation control for controlling the scanner motor 510 to rotate at the scanner speed VS by the motor driver 810 (S460, see timing t2 in FIG. 4). Thereafter, the controller 800 starts rotation control for controlling the process motor 811 to rotate at the process speed VN by the motor driver 810 (S470, see timing t3 in FIG. 4).

A reason why it is possible to prevent a delay on sheet feeding timing even though the target fixing temperature is set to the particular high temperature TNH or the particular low temperature TNL, which are lower than the activation temperature TH, in the pre-duplex-printing process will be provided below. As shown in FIG. 4, in the pre-duplex-printing process, the timing to start the temperature control for the fuser 700 is earlier than that in the pre-simplex-printing process. Therefore, in the pre-duplex-printing process, it is possible to secure a longer period of time between the timing to start the temperature control for the fuser 700 and the sheet feeding timing (see timing t4 in FIG. 4) in comparison with the pre-simplex-printing process. Hence, even when the target fixing temperature is set to the particular high temperature TNH or the particular low temperature TNL, it is possible to make the temperature of the fixing belt 710 equal to or higher than the temperature suitable for fixing before the sheet W reaches the nip P.

Further, a reason why the timing to start the rotation control for the scanner motor 510 in the pre-duplex-printing process is later than that in the pre-simplex-printing process will be provided below. Each of the process motor 811 and the scanner motor 510 needs a large amount of electricity for starting the rotation control therefor. Therefore, a short time interval between the timing to start the rotation control for the process motor 811 and the timing to start the rotation control for the scanner motor 510 results in a great load placed on the motor driver 810. Hence, in the duplex printing, the scanner motor 510 is driven to rotate after the process motor 811 begins to be rotated at the low process speed VL. Thereby, it is possible to reduce the load placed on the motor driver 810.

After completing the pre-duplex-printing process, the controller 800 goes to S190 in FIG. 3. In S190, the controller 800 controls the sheet feeder 200 to feed one sheet W (see timing t4 in FIG. 4). Then, the controller 800 controls the process unit 600 to start transferring a toner image onto a first side of the sheet W passing through the transfer position X1 (S200). Afterward, the sheet W with the toner image transferred thereon is heated for a period of time during which the sheet W is passing through the nip P of the fuser 700 (see timings t5 to t7 in FIG. 4). During this period of time, since the target fixing temperature is set to the particular high temperature TNH or the particular low temperature TNL, the temperature of the sheet W is lower than when the simplex printing is performed, as indicated by the graph line G2 in FIG. 4.

Subsequently, when determining that a particular timing (see timing t6 in FIG. 4) at which a leading end of the sheet W in the conveyance direction is positioned between the fuser 700 and the discharge rollers 130 has come, the controller 800 starts rotating the discharge motor 812 in the forward direction (S210). Thereafter, the controller 800 determines whether a trailing end of the sheet W in the conveyance direction has passed by the conveyance guide 150 (S220). Immediately before the trailing end of the sheet W in the conveyance direction passes by the conveyance guide 150, the sheet W is bent in a U-shape by the conveyance guide 150 and the discharge rollers 130. Therefore, after the trailing end of the sheet W in the conveyance direction has passed by the conveyance guide 150, the trailing end of the sheet W in the conveyance direction moves from the conveyance guide 150 to the first re-conveyance guide 161 by a restoring force of the sheet W. Thereby, the re-conveyor 160 is allowed to re-convey the sheet W. When determining that the trailing end of the sheet W in the conveyance direction has not passed by the conveyance guide 150 (S220: No), the controller 800 waits in a standby state. Meanwhile, when determining that the trailing end of the sheet W in the conveyance direction has passed by the conveyance guide 150 (S220: Yes), the controller 800 performs a re-conveyance process.

Figure 7:
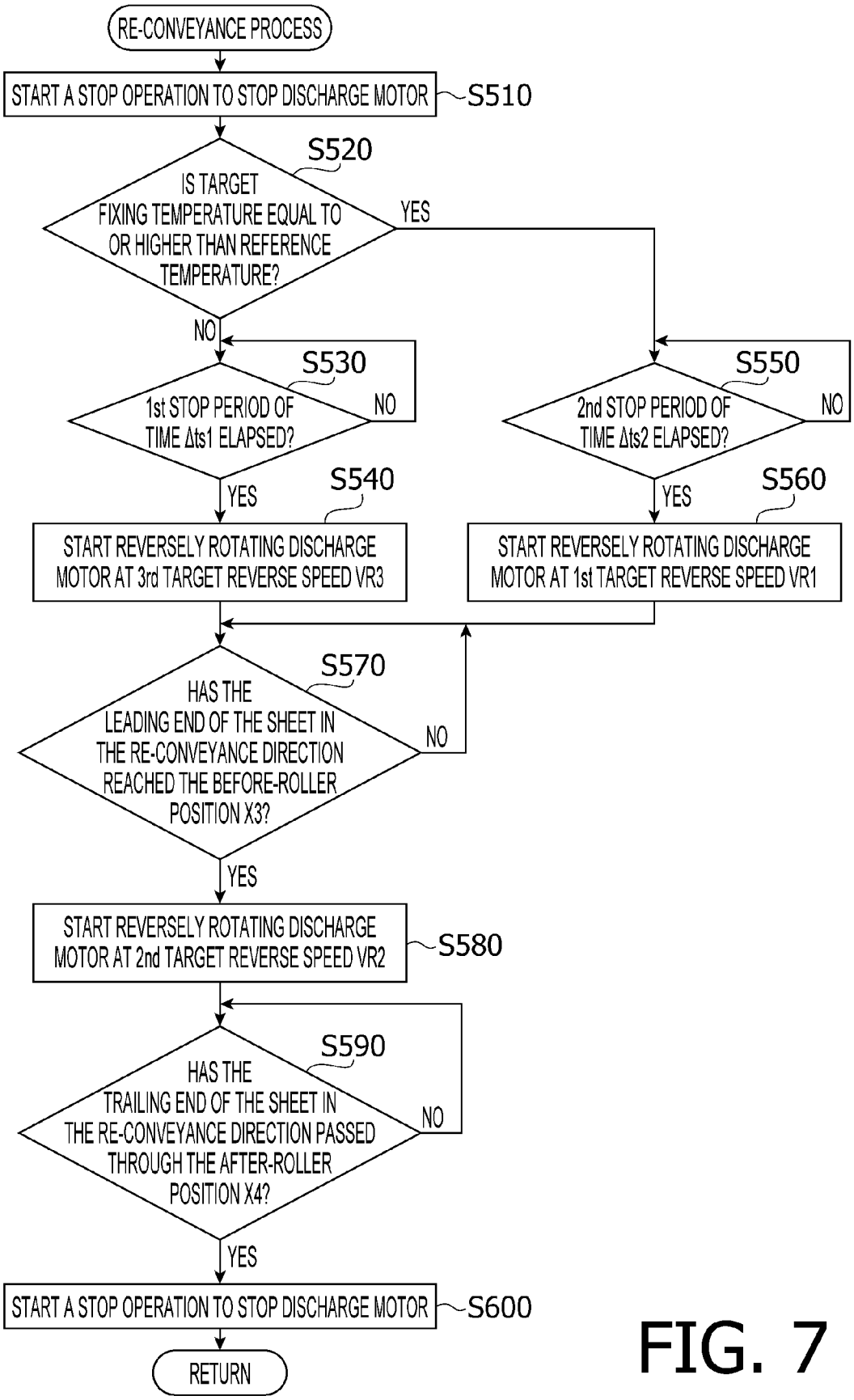
FIG. 7 is a flowchart showing a procedure of a re-conveyance process in the illustrative embodiment according to one or more aspects of the present disclosure.

FIG. 7 is a flowchart showing a procedure of the re-conveyance process. The re-conveyance process is for controlling the re-conveyor 160 to perform a re-conveyance operation. Firstly, the controller 800 starts a stop operation to stop the discharge motor 812 (S510, see timing t8 in FIG. 4). At this time, the leading end of the sheet W in the conveyance direction is exposed to the outside of the casing 100 via the discharge port 110, whereas the trailing end of the sheet W in the conveyance direction is pinched by the discharge rollers 130. The controller 800 determines whether the target fixing temperature is equal to or higher than a reference temperature (S520). In the illustrative embodiment, when the temperature (i.e., the particular high temperature TNH or the particular low temperature TNL) set in the pre-duplex-printing process is equal to or higher than the reference temperature, the controller 800 determines that the target fixing temperature is equal to or higher than the reference temperature (S520: Yes). Meanwhile, when the temperature (i.e., the particular high temperature TNH or the particular low temperature TNL) set in the pre-duplex-printing process is made lower than the reference temperature (see S270 in FIG. 3), the controller 800 determines that the target fixing temperature is not equal to or higher than the reference temperature (S520: No).

When determining that the target fixing temperature is not equal to or higher than the reference temperature (S520: No), the controller 800 performs first re-conveyance control for controlling the re-conveyor 160 to re-convey the sheet W passed through the fuser 700 to the process unit 600 in a first period of time ΔT1.

More specifically, the controller 800 determines whether a first stop period of time Δts1 has elapsed since the stop operation to stop the discharge motor 812 was started (S530). When determining that the first stop period of time Δts1 has not elapsed (S530: No), the controller 800 waits in a standby state. Meanwhile, when determining that the first stop period of time Δts1 has elapsed (S530: Yes), the controller 800 starts rotation control for controlling the discharge motor 812 to reversely rotate at a third target reverse speed VR3 by the motor driver 810 (S540, see timing t9 in FIG. 4). The third target reverse speed VR3 is higher than the first target reverse speed VR1. Thereby, each discharge roller 130 is reversely rotated at a rotational speed corresponding to the third target reverse speed VR3, and the sheet W begins to be conveyed to the re-conveyance path R2.

Afterward, the controller 800 determines whether a leading end of the sheet W in the re-conveyance direction has reached the before-roller position X3 (S570). The controller 800 may make the determination in S570, e.g., based on a signal from a sheet sensor (not shown) disposed along the re-conveyance path R2 or a period of time elapsed since the timing to start reversely rotating the discharge rollers 130. When determining that the leading end of the sheet W in the re-conveyance direction has not reached the before-roller position X3 (S570: No), the controller 800 waits in a standby state. Meanwhile, when determining that the leading end of the sheet W in the re-conveyance direction has reached the before-roller position X3 (S570: Yes), the controller 800 starts rotation control for controlling the discharge motor 812 to rotate at a second target reverse speed VR2 by the motor driver 810 (S580, see timing t11 in FIG. 4). The second target reverse speed VR2 is lower than the third target reverse speed VR3. The rotational speed of the discharge rollers 130 corresponding to the second target reverse speed VR2 is identical to the rotational speed of the rollers 165 corresponding to the process speed VN. Namely, the rotational speed of the discharge motor 812 (the discharge rollers 130) in the backward direction is higher than the process speed VN until the leading end of the sheet W in the re-conveyance direction reaches the most upstream one of the rollers 165 in the re-conveyance direction. Therefore, it is possible to shorten a period of time required for re-conveying the sheet W. Meanwhile, after the leading end of the sheet W in the re-conveyance direction has passed through the before-roller position X3, the leading end of the sheet W in the re-conveyance direction comes into contact with the most upstream one of the rollers 165 in the re-conveyance direction, and the trailing end of the sheet W in the re-conveyance direction comes into contact with the discharge rollers 130. However, since the rotational speed of the rollers 165 is identical to the rotational speed of the discharge rollers 130 in the backward direction, the sheet W is stably re-conveyed without being crinkled.

Thereafter, when the trailing end of the sheet W in the re-conveyance direction has passed through the discharge position X2, the sheet W is re-conveyed only by the rollers 165 and guided toward the registration rollers 320 by the fourth re-conveyance guide 164. The controller 800 determines whether the trailing end of the sheet W in the re-conveyance direction has passed through the after-roller position X4 (S590). The controller 800 may make the determination in S590, e.g., based on a signal from a sheet sensor (not shown) disposed along the re-conveyance path R2 or a period of time elapsed since the timing to start reversely rotating the discharge rollers 130. When determining that the trailing end of the sheet W in the re-conveyance direction has not passed through the after-roller position X4 (S590: No), the controller 800 waits in a standby state. Meanwhile, when determining that the trailing end of the sheet W in the re-conveyance direction has passed through the after-roller position X4 (S590: Yes), the controller 800 starts a stop operation to stop the discharge motor 812 (S600, see timing t13 in FIG. 4). Thereafter, the controller 800 terminates the re-conveyance process. The first period of time ΔT1 for the first re-conveyance control is a period of time between the timing t7 and the timing t13 in FIG. 4.

When determining that the target fixing temperature is equal to or higher than the reference temperature (S520: Yes), the controller 800 performs the second re-conveyance control. The second re-conveyance control is for controlling the re-conveyor 160 to convey the sheet W passed through the fuser 700 to the process unit 600 in a second period of time ΔT2. The second period of time ΔT2 is longer than the first period of time ΔT1.

More specifically, the controller 800 determines whether a second stop period of time Δts2 has elapsed since the stop operation to stop the discharge motor 812 was started (S550). The second stop period of time Δts2 is longer than the first stop period of time Δts1. When determining that the second stop period of time Δts2 has not elapsed (S550: No), the controller 800 waits in a standby state. Meanwhile, when determining that the second stop period of time Δts2 has elapsed (S550: Yes), the controller 800 starts rotation control for controlling the discharge motor 812 to rotate at the first target reverse speed VR1 (i.e., VR1H or VR1L) set in the pre-duplex-printing process (S560, see timing t10 in FIG. 4). Thereby, the discharge rollers 130 are reversely rotated at the first target reverse speed VR1, and the sheet W begins to be conveyed to the re-conveyance path R2. Namely, in the second re-conveyance control, a period of time during which the sheet W stops in the discharge position X2 is longer than that in the first re-conveyance control. Further, in the second re-conveyance control, a re-conveyance speed in a section from the discharge position X2 to the before-roller position X3 on the re-conveyance path R2 is lower than that in the first re-conveyance control. Therefore, in the second re-conveyance control, since a period of time required for re-conveying the sheet W passed through the fuser 700 to the before-roller position X3 is longer than that in the first re-conveyance control, it is possible to more adequately cool the sheet W for the longer period of time.

Afterward, when determining that the leading end of the sheet W in the re-conveyance direction has not reached the before-roller position X3 (S570: No), the controller 800 waits in a standby state. Meanwhile, when determining that the leading end of the sheet W in the re-conveyance direction has reached the before-roller position X3 (S570: Yes), the controller 800 starts rotation control for controlling the discharge motor 812 to rotate at the second target reverse speed VR2 (S580, see timing t12 in FIG. 4). Thereafter, when determining that the trailing end of the sheet W in the re-conveyance direction has not passed through the after-roller position X4 (S590: No), the controller 800 waits in a standby state. Meanwhile, when determining that the trailing end of the sheet W in the re-conveyance direction has passed through the after-roller position X4 (S590: Yes), the controller 800 starts a stop operation to stop the discharge motor 812 (S600, see timing t14 in FIG. 4). Thereafter, the controller 800 terminates the re-conveyance process. The second period of time ΔT2 is a period of time between the timing t7 and the timing t14. As described above, the second period of time ΔT2 is longer than the first period of time ΔT1. Therefore, in the second re-conveyance control, it is possible to more efficiently cool the re-conveyed sheet W than in the first re-conveyance control.

After completing the re-conveyance process, the controller 800 goes to S240 in FIG. 3. In S240, the controller 800 controls the process unit 600 to start transferring a toner image onto a second side of the sheet W passing through the transfer position X1. Afterward, the sheet W with the toner image transferred thereon is heated for a period of time during which the sheet W is passing through the nip P of the fuser 700. Next, when determining that the timing at which the leading end of the sheet W in the conveyance direction is positioned between the fuser 700 and the discharge rollers 130 has come, the controller 800 starts rotating the discharge motor 812 in the forward direction (S250). Subsequently, the controller 800 determines whether all of the pages specified by the print instruction have been completely printed (S260). When determining that all of the pages specified by the print instruction have been completely printed (S260: Yes), the controller 800 performs the aforementioned post processing (S170). Thereafter, the controller 800 terminates the print control process. When determining that all of the pages specified by the print instruction have not been completely printed (S260: No), the controller 800 sets again the target fixing temperature based on an elapsed period of time (S270). Thereafter, the controller 800 goes back to S190, in which the controller 800 performs duplex printing for a next sheet W. Here, when a particular period of time has elapsed since the temperature control for the fuser 700 was started, and heat is accumulated at the fuser 700, the controller 800 sets the target fixing temperature to be further lower than the particular high temperature TNH or the particular low temperature TNL.

According to the illustrative embodiment, when the target fixing temperature is equal to or higher than the reference temperature (S520: Yes), a re-conveyance period of time required for the re-conveyor 160 to convey the sheet W passed through the fuser 700 to the process unit 600 is longer than when the target fixing temperature is lower than the reference temperature (S520: No) (see ΔT1 and ΔT2 in FIG. 4). Therefore, even when the target fixing temperature is equal to or higher than the reference temperature, it is possible to more adequately cool the sheet W being conveyed by the re-conveyor 160 than when the re-conveyance period of time is the same as when the target fixing temperature is lower than the reference temperature.

Suppose, for instance, that the first re-conveyance control is performed even when the target fixing temperature is equal to or higher than the reference temperature. In such a case, particularly, a first sheet W is re-conveyed after heated to a high temperature by the fuser 700. Then, in the first re-conveyance control, since the re-conveyance period of time is the first period of time ΔT1 shorter than the second period of time ΔT2, the first sheet W again passes through the fuser 700 without being adequately cooled. Thus, the first sheet W, which is still at a high temperature, is guided by the conveyance guide 150. Hence, there is a risk that toner on the first side of the first sheet W might be melted by heat and attached to the conveyance guide 150, and it might cause deterioration in accuracy for guiding sheets W by the conveyance guide 150. In contrast, according to the illustrative embodiment, when the target fixing temperature is equal to or higher than the reference temperature, the second re-conveyance control is performed in which the re-conveyance period of time is longer than in the first re-conveyance control. Therefore, the first sheet W again passes through the fuser 700 after adequately cooled. Thus, as indicated by the graph line G2 in FIG. 4, the first sheet W, which is cooled to a relatively low temperature, is guided by the conveyance guide 150. Hence, it is possible to prevent the accuracy for guiding sheets W along the conveyance guide 150 from being deteriorated due to attachment of toner on the first side of the first sheet W to the conveyance guide 150. It is noted that, in the illustrative embodiment, as described above, the air current V crossing the conveyance path R1 and the re-conveyance path R2 is generated in the casing 100 (see FIG. 1). By the air current V, it is possible to further cool the re-conveyed sheet W.

Further, in the illustrative embodiment, it is possible to differentiate the re-conveyance period of time between the first re-conveyance control and the second re-conveyance control, by changing the rotational speed of the discharge motor 812 (the discharge rollers 130) in the backward direction depending on whether the target fixing temperature is equal to or higher than the reference temperature (see S540 and S560 in FIG. 7). Thereby, it is possible to more efficiently prevent the user from misunderstanding that a sheet W has been discharged when a state where the sheet W is partially exposed to the outside of the casing 100 is maintained for a long time, than when the re-conveyance period of time is differentiated between the first re-conveyance control and the second re-conveyance control only by differentiating the stop period of time therebetween.

Further, in the illustrative embodiment, when the target fixing temperature is equal to or higher than the reference temperature, it is possible to cool the sheet W by making the re-conveyance period of time longer. Meanwhile, when the target fixing temperature is lower than the reference temperature, it is possible to shorten the period of time required for duplex printing by making the re-conveyance period of time shorter.

Further, in the illustrative embodiment, it is possible to differentiate the re-conveyance period of time between the first re-conveyance control and the second re-conveyance control by differentiating the stop period of time (see S530 and S550 in FIG. 7) depending on whether the target fixing temperature is equal to or higher than the reference temperature.

Further, in the illustrative embodiment, at least the target fixing temperature for the first sheet W to pass through the fuser 700 for the first time may be set to a temperature equal to or higher than the reference temperature. Therefore, it is possible to cool the sheet W while bringing the temperature of the fuser 700 to a fixable temperature (e.g., the temperature suitable for fixing) earlier after acceptance of a print instruction for duplex printing, than when the target fixing temperature for the first sheet W is set to be lower than the reference temperature. It is noted that the target fixing temperature for the first sheet W to pass through the fuser 700 for the second time may be set to a temperature lower than the reference temperature. Further, the target fixing temperature for one or more subsequent sheets W to continuously pass through the fuser 700 may be still set to the temperature lower than the reference temperature.

Further, the higher the target fixing temperature is, the larger the quantity of heat accumulated in the fuser 700 is. Therefore, there is a risk that the sheet W might be heated to a higher temperature as a larger quantity of heat is applied to the sheet W while the sheet W is passing through the fuser 700. In view of the risk, in the illustrative embodiment, the higher the target fixing temperature is, the lower the first target reverse speed VR1 is set to be (see S420 and 430 in FIG. 6). Thereby, the second period of time ΔT2 is set to be longer. Thus, it is possible to more certainly prevent the sheet W passed through the fuser 700 from being re-conveyed to the process unit 600 although the sheet W is still at a high temperature, than when the second period of time ΔT2 is always constant.

Further, in the illustrative embodiment, the casing 100 includes the conveyance guide 150 configured to contact the first side of the sheet W passed through the fuser 700. It is noted that the first side of the sheet W is opposite to the second side that faces the fixing belt 710 when the sheet W once passed through the fuser 700 again passes through the fuser 700. After the sheet W has passed through the fuser 700 by which the toner image was fixed onto the first side, the sheet W is cooled while being conveyed by the re-conveyor 160. Therefore, it is possible to prevent toner on the first side of the sheet W from being attached to the conveyance guide 150.

Further, in the illustrative embodiment, the trailing end in the conveyance direction of the sheet W conveyed by the discharge rollers 130 is guided by the first re-conveyance guide 161 after completely passing by the conveyance guide 150. Then, when the rotational directions of the discharge rollers 130 are reversed, the sheet W is guided to the re-conveyor 160 by the first re-conveyance guide 161. Accordingly, it is possible to guide the sheet W to the re-conveyor 160 without having to provide a separate switching mechanism for switching between the conveyance path R1 from the fuser 700 to the discharge rollers 130 and the re-conveyance path R2 from the discharge rollers 130 to the re-conveyor 160.

Further, in the illustrative embodiment, when simplex printing is performed, the target fixing temperature is set to the activation temperature TH higher than the particular high temperature TNH (see S320 in FIG. 5). Thereby, it is possible to promptly bring the temperature of the fuser 700 to a fixable temperature (e.g., the temperature suitable for fixing). Further, in the illustrative embodiment, when the target fixing temperature is set to the activation temperature TH, the timing to start the rotation control for the process motor 811 is made later than that in duplex printing (see timings t1 and t3 in FIG. 4). Thereby, it is possible to shorten a period of time for preparatory driving of the process unit 600 or the fuser 700.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

[Modifications]

In the aforementioned illustrative embodiment, the target fixing temperature in the temperature control for the fuser 700 has been exemplified as a temperature of the fuser 700. However, the temperature of the fuser 700 may be a temperature acquired based on a temperature signal from a temperature sensor such as the thermistor 770.

In the aforementioned illustrative embodiment, the re-conveyance period of time is differentiated between the first re-conveyance control and the second re-conveyance control, by the difference therebetween in the rotational speed of the discharge motor 812 (the discharge rollers 130) in the backward direction (see S540 and S560 in FIG. 7) and the difference therebetween in the stop period of time during which the discharge motor 812 is stopped (see S530 and S550). However, the re-conveyance period of time may be differentiated between the first re-conveyance control and the second re-conveyance control, by only one of the difference therebetween in the rotational speed of the discharge motor 812 (the discharge rollers 130) in the backward direction and the difference therebetween in the stop period of time. Further, the printer 10 may be configured to perform rotation control for the rollers 165 of the re-conveyor 160 independently with a motor different from the process motor 811. In such a configuration, the sheet W may be stopped or conveyed at a lower speed on the re-conveyance path R2 in the casing 100.

In the aforementioned illustrative embodiment, the controller 800 determines in S410 whether the outside air temperature is equal to or lower than the threshold temperature (e.g., 15° C.). Nonetheless, the controller 800 may determine whether the temperature of the fixing belt 710 before receipt of the print instruction is equal to or lower than a threshold temperature (e.g., 152° C.), based on a temperature signal from the thermistor 770. The higher the temperature of the fuser 700 before receipt of the print instruction for duplex printing, the larger the quantity of heat accumulated in the fuser 700 is. Therefore, there is a risk that the sheet W might be heated to a higher temperature as a larger quantity of heat is applied to the sheet W while the sheet W is passing through the fuser 700. In view of the risk, the higher the temperature of the fuser 700 before receipt of the print instruction for duplex printing is, the lower the first target reverse speed VR1 may be set to be. Thereby, it is possible to make the second period of time ΔT2 longer. Thus, it is possible to more certainly prevent the sheet W passed through the fuser 700 from being re-conveyed to the process unit 600 although the sheet W is still at a high temperature, than when the second period of time ΔT2 is always constant.

Further, in the processes (see FIGS. 3 and 5 to 7) exemplified in the aforementioned illustrative embodiment, some steps may be omitted. Further, the operations to be executed in some steps may be changed. Further, the order of some steps may be changed.

In the aforementioned illustrative embodiment, the printer 10 is configured to perform printing using a single color (black) of toner. However, the color of the toner to be used for printing is not limited to the color (black) exemplified in the illustrative embodiment. Further, the number of colors to be used for printing may be two or more.

Further, aspects of the present disclosure may be applied to copy machines, facsimile machines, and multi-function peripherals, as well as printers.

In the aforementioned illustrative embodiment, the photoconductive body 610 is a roller-shaped body. However, for instance, the photoconductive body 610 may be a belt-shaped body.

The exposure device 500 may be a device having a plurality of LED elements arranged in a main scanning direction parallel to the rotational axis direction of the photoconductive body 610.

In the aforementioned illustrative embodiment, the fuser 700 includes the fixing belt 710. However, the fuser 700 may include a fixing roller instead of the fixing belt 710.

The operations and/or the processes described as being executed by the single CPU 801 in the aforementioned illustrative embodiment may be executed by one or more hardware elements such as a single CPU, a plurality of CPUs, one or more ASICs, and a combination of one or more CPUs and one or more ASICs. The controller 800 is a generic term that represents hardware elements (e.g., the CPU 801) for controlling the printer 10. The controller 800 may not necessarily be a single hardware unit existing in the printer 10.

What is claimed is:

1. An image forming apparatus comprising:

a process unit configured to form a toner image on a sheet;

a fuser configured to heat the sheet passed through the process unit thereby thermally fixing the toner image onto the sheet;

a re-conveyor configured to convey the sheet passed through the fuser to the process unit; and a controller configured to perform particular duplex printing in response to receipt of a print instruction, the particular duplex printing comprising:

when the sheet is a first sheet to pass through the fuser for a first time after the print instruction has been received, setting a target temperature of the fuser for thermally fixing the toner image onto the sheet to a second temperature higher than a first temperature;

when the sheet is the first sheet to pass through the fuser for a second time, setting the target temperature of the fuser to the first temperature;

when the sheet is a second sheet to pass through the fuser for a first time after the first sheet has passed through the fuser for the second time, setting the target temperature of the fuser to the first temperature;

when the sheet is the second sheet to pass through the fuser for a second time, setting the target temperature of the fuser to the first temperature;

when the target temperature of the fuser is the first temperature, controlling the re-conveyor to convey the sheet passed through the fuser to the process unit in a first period of time; and when the target temperature of the fuser is the second temperature, controlling the re-conveyor to convey the sheet passed through the fuser to the process unit in a second period of time, the second period of time being longer than the first period of time.

2. The image forming apparatus according to claim 1, wherein the re-conveyor comprises a re-conveyance roller configured to convey the sheet toward the process unit, and wherein the controller is further configured to:

when the target temperature of the fuser is the first temperature, control the re-conveyance roller to convey the sheet at a first conveyance speed; and when the target temperature of the fuser is the second temperature, control the re-conveyance roller to convey the sheet at a second conveyance speed, the second conveyance speed being lower than the first conveyance speed.

3. The image forming apparatus according to claim 2, wherein the first conveyance speed is higher than a specific conveyance speed at which the sheet passes through the fuser, and wherein the second conveyance speed is lower than the specific conveyance speed.

4. The image forming apparatus according to claim 1, wherein the controller is further configured to:

when the target temperature of the fuser is the first temperature, control the re-conveyor to stop the sheet for a third period of time; and when the target temperature of the fuser is the second temperature, control the re-conveyor to stop the sheet for a fourth period of time, the fourth period of time being longer than the third period of time.

5. The image forming apparatus according to claim 4, wherein the controller is further configured to:

when the target temperature of the fuser is the first temperature, control the re-conveyor to stop the sheet for the third period of time before beginning to convey the sheet to the process unit after the sheet has passed through the fuser; and when the target temperature of the fuser is the second temperature, control the re-conveyor to stop the sheet for the fourth period of time before beginning to convey the sheet to the process unit after the sheet has passed through the fuser.

6. The image forming apparatus according to claim 1, wherein the controller is further configured to, as a temperature of the fuser before execution of the duplex printing is higher, make the second period of time longer.

7. The image forming apparatus according to claim 1, wherein the controller is further configured to, as the second temperature is higher, make the second period of time longer.

8. The image forming apparatus according to claim 1, further comprising a guide configured to guide the sheet in contact with a specific surface of the sheet, the specific surface being opposite to an other surface of the sheet that faces a heater of the fuser when the sheet passes through the fuser.

9. The image forming apparatus according to claim 8, wherein the guide comprises a curved portion configured to guide the sheet in contact with the specific surface of the sheet, the curved portion being concave in a direction of the specific surface of the sheet being guided by the guide, and wherein the re-conveyor comprises:

a reversal roller configured to convey the sheet being guided by the guide, the reversal roller being configured to reverse a conveying direction of the sheet when the sheet has passed through the guide; and a second guide disposed on an opposite side of the fuser with respect to the guide, the second guide being configured to guide the sheet in a reversed conveying direction.

10. The image forming apparatus according to claim 1, wherein the controller is further configured to perform particular simplex printing comprising bringing a temperature of the fuser to a third temperature, the third temperature being higher than the second temperature.

11. The image forming apparatus according to claim 10, further comprising a motor configured to drive at least one of the process unit and the fuser, wherein the controller is further configured to make a timing to start driving the motor when the temperature of the fuser is brought to the third temperature in the particular simplex printing later than when the temperature of the fuser is brought to the second temperature in the particular duplex printing.

12. The image forming apparatus according to claim 1, wherein the controller comprises:

a processor; and a memory storing processor-executable instructions configured to, when executed by the processor, cause the processor to perform the particular duplex printing.

13. The image forming apparatus according to claim 1, wherein the particular duplex printing further comprises:

when an outside air temperature is equal to or lower than a threshold temperature before the first sheet passes through the fuser for the first time after receipt of the print instruction, setting the target temperature of the fuser to the second temperature; and when the outside air temperature is higher than the threshold temperature before the first sheet passes through the fuser for the first time after receipt of the print instruction, setting the target temperature of the fuser to the first temperature.

14. A method adapted to be implemented on a processor coupled with an image forming apparatus comprising a process unit, a fuser, and a re-conveyor, the method comprising:

when the sheet is a first sheet to pass through the fuser for a first time after the print instruction has been received, setting a target temperature of the fuser for thermally fixing the toner image onto the sheet to a second temperature higher than a first temperature;

when the sheet is the first sheet to pass through the fuser for a second time, setting the target temperature of the fuser to the first temperature;

when the sheet is a second sheet to pass through the fuser for a first time after the first sheet has passed through the fuser for the second time, setting the target temperature of the fuser to the first temperature;

when the sheet is the second sheet to pass through the fuser for a second time, setting the target temperature of the fuser to the first temperature;

when the target temperature of the fuser is the first temperature, controlling the re-conveyor to convey the sheet passed through the fuser to the process unit in a first period of time; and when the target temperature of the fuser is the second temperature higher than the first temperature, controlling the re-conveyor to convey the sheet passed through the fuser to the process unit in a second period of time, the second period of time being longer than the first period of time.

15. An image forming apparatus comprising:

a process unit configured to form a toner image on a sheet;

a fuser configured to heat the sheet passed through the process unit thereby thermally fixing the toner image onto the sheet;

a re-conveyor configured to convey the sheet passed through the fuser to the process unit; and a controller configured to perform particular duplex printing in response to receipt of a print instruction, the particular duplex printing comprising:

when an outside air temperature is equal to or lower than a threshold temperature before a first sheet passes through the fuser for a first time after receipt of the print instruction, setting a target temperature of the fuser to a second temperature higher than a first temperature;

when the outside air temperature is higher than the threshold temperature before the first sheet passes through the fuser for the first time after receipt of the print instruction, setting the target temperature of the fuser to the first temperature;

when the target temperature of the fuser is the first temperature, controlling the re-conveyor to convey the sheet passed through the fuser to the process unit in a first period of time; and when the target temperature of the fuser is the second temperature higher than the first temperature, controlling the re-conveyor to convey the sheet passed through the fuser to the process unit in a second period of time, the second period of time being longer than the first period of time.

16. The image forming apparatus according to claim 15, wherein the controller is further configured to:

when the target temperature of the fuser is the first temperature, control the re-conveyor to stop the sheet for a third period of time; and when the target temperature of the fuser is the second temperature, control the re-conveyor to stop the sheet for a fourth period of time, the fourth period of time being longer than the third period of time.

17. The image forming apparatus according to claim 15, wherein the controller is further configured to, as a temperature of the fuser before execution of the duplex printing is higher, make the second period of time longer.

18. The image forming apparatus according to claim 15, wherein the controller is further configured to, as the second temperature is higher, make the second period of time longer.

19. The image forming apparatus according to claim 15, wherein the controller is further configured to perform particular simplex printing comprising bringing a temperature of the fuser to a third temperature, the third temperature being higher than the second temperature.

* * * * *